US007210950B2

(12) United States Patent
Tanaka et al.

(10) Patent No.: US 7,210,950 B2
(45) Date of Patent: May 1, 2007

(54) CONNECTOR FOR MEMORY CARD

(75) Inventors: Hirohisa Tanaka, Tsu (JP); Toshihiro Yamamoto, Tsu (JP); Masato Kawashima, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/548,433

(22) PCT Filed: May 25, 2004

(86) PCT No.: PCT/JP2004/007098

§ 371 (c)(1),
(2), (4) Date: Sep. 8, 2005

(87) PCT Pub. No.: WO2004/105190

PCT Pub. Date: Dec. 2, 2004

(65) Prior Publication Data

US 2006/0183378 A1 Aug. 17, 2006

(30) Foreign Application Priority Data

May 26, 2003 (JP) ..... 2003-148224
Jun. 3, 2003 (JP) ..... 2003-158359

(51) Int. Cl.
*H01R 29/00* (2006.01)

(52) U.S. Cl. ..... 439/188

(58) Field of Classification Search ..... 439/188
See application file for complete search history.

(56) References Cited

U.S. PATENT DOCUMENTS 6,557,761 B1 5/2003 Oya et al.
6,585,542 B2 * 7/2003 Nishio et al. ..... 439/630
6,616,050 B1 * 9/2003 Oki et al. ..... 235/479
6,619,991 B2 * 9/2003 Nishio et al. ..... 439/630

(Continued)

FOREIGN PATENT DOCUMENTS

JP 45-9211 4/1970

(Continued)

OTHER PUBLICATIONS

English Language Abstract of JP 3252133.

(Continued)

*Primary Examiner*—Briggitte R. Hammond
(74) *Attorney, Agent, or Firm*—Greenblum & Bernstein, P.L.C.

(57) ABSTRACT

In a connector for memory card, it is objected to stabilize contact of detection switch for detecting insertion of a memory card, and to prevent breakage of the memory card due to bounce-out when it is taken out. The detection switch is held on a contact block with contacts which are to be contacted with terminals of the memory card, and comprised of a fixed contact plate and a movable spring piece. A groove having substantially V-shape is formed on a contacting portion of the movable spring piece so as to contact with the fixed contact plate at two points. Furthermore, elastic protrusions that can fit to recessed portions for locking formed on the memory card just before the slider holding the memory card reaches to an initial position is formed on a top plate of the housing, so that the bounce-out of the memory card is prevented.

10 Claims, 13 Drawing Sheets

U.S. PATENT DOCUMENTS

| | | | | |
|---|---|---|---|---|
| 6,648,694 | B2 * | 11/2003 | Takamori et al. | 439/630 |
| 6,719,589 | B2 * | 4/2004 | Nishio et al. | 439/630 |
| 2005/0101170 | A1 | 5/2005 | Tanaka et al. | |
| 2005/0221649 | A1 | 10/2005 | Tanaka et al. | |

FOREIGN PATENT DOCUMENTS

| | | |
|---|---|---|
| JP | 2000-227945 | 8/2000 |
| JP | 2001-135424 | 5/2001 |
| JP | 2001-143788 | 5/2001 |
| JP | 2001-244026 | 9/2001 |
| JP | 3252133 | 11/2001 |
| JP | 2002-352911 | 12/2002 |
| JP | 2003-109704 | 4/2003 |

OTHER PUBLICATIONS

English Language Abstract of JP 2001-143788.
English Language Abstract of JP 2003-109704.
English Language Abstract of JP 2002-352911.
English Language Abstract of JP 45-9211.
English Language Abstract of JP 2001-244026.
English Language Abstract of JP 2001-135424.
English Language Abstract of JP 2000-227945.

* cited by examiner

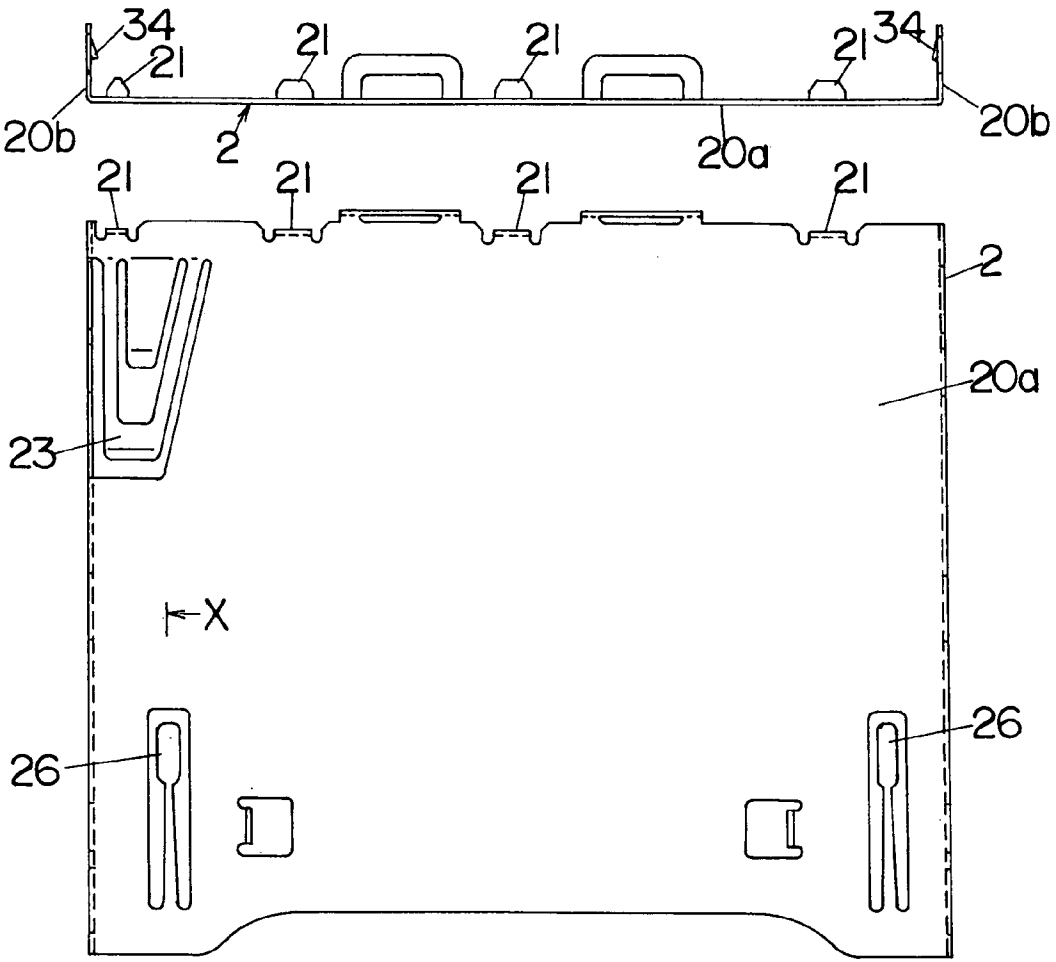
FIG. 10C
FIG. 10A
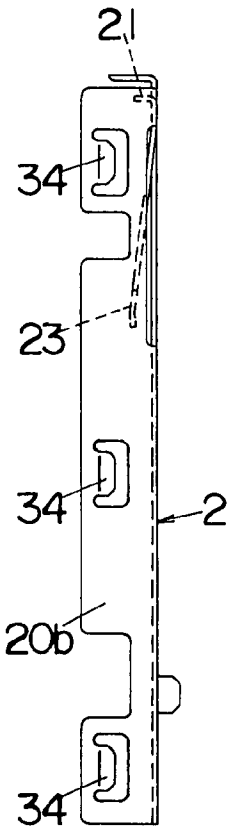
FIG. 10B

CONNECTOR FOR MEMORY CARD

TECHNICAL FIELD

The present invention relates to a connector for memory card to which a memory card such as a mini SD card is connected detachably.

BACKGROUND ART

As shown in Japanese Patent No. 3252133, for example, this type of connector for memory card comprises a housing on which an opening is provided on a front face so as to insert a memory card therein, a plurality of contacts that is held in the housing and in contact with terminals provided on the memory card, a slider that contacts with the memory card inserted into the housing and is moved along an inserting direction of the memory card into the housing, a pressing spring for pressing the slider in a direction of taking out the memory card, and a push-on and push-off locking mechanism that locks movement of the slider when the slider is moved to a locking position inner than a position at which the terminals of the memory card come into contact with the contacts and releases locking of the slider when the slider is moved to a lock releasing position inner than the locking position.

In such a connector for memory card having the push-on and push-off locking mechanism, when the memory card is inserted into the housing from the opening thereof, a front end of the memory card engages with the slider, and the slider together with the memory card starts to move in the housing in a direction opposing to the opening. Following to the movement of the slider, the pressing spring is charged. When the slider is moved to the locking position slightly inner than a position at which the terminals provided in the vicinity of the front end of the memory card come into contact with the contacts, the movement of the slider is locked by the locking mechanism, and in spite of the pressing force of the pressing spring, the slider and the memory card engaged therewith remain at the locking position even after pressing force applied to the memory card is removed. To take out the memory card from the connector, the memory card is further pushed into the housing for moving the slider to the position slightly inner than the locking position. Then, the locking of the slider by the locking mechanism is released, and the slider and the memory card engaged therewith are moved toward the side of the opening of the housing by the pressing force of the pressing spring. Then, since a rear end of the memory card is greatly protruded outward from the opening of the housing, the memory card can be taken out from the connector.

When the pressing force of the pressing spring is too strong, the memory card may bounce out from the housing with great force, and the memory card may be damaged due to falling. On the contrary, when the pressing force of the pressing spring is too weak, the pressing force may become weaker than frictional force caused by contact pressure of the contacts against the terminals of the memory card or the like, so that the slider and the memory card engaged therewith may be stopped before departing the terminals of the memory card from the contacts, resulting insufficient operation. Accordingly, it is impossible to make the pressing force of the pressing spring be equal to or smaller than a certain constant value, and an independent mechanism for preventing the bounce-out of the memory card is required.

On the other hand, there are some connectors for memory card each having a detection switch for detecting insertion of the memory card built-in. FIG. 12A to FIG. 12D show a configuration of a detection switch in a connector for mini SD card. In the connector for mini SD card, it is required to reduce overall depth of the housing as smaller as possible. Thus, as shown in the figures, a fixed contact plate 30 and a movable spring piece 31 that constitute the detection switch are provided integrally with a base member 7 of a contact block for holding a plurality of contacts by insert molding. The fixed contact plate 30 is provided at a protruding portion 71 formed so as to protrude forward from an end of the base member 7 of the contact block, and a fixed contact 30*a* is exposed to the inner side of the connector in the width direction from the protruding portion 71 so as to contact with an elastic contact portion 31*a* of the movable spring piece 31. Furthermore, the movable spring piece 31 is formed so that the elastic contact portion 31*a* is inclined with respect to the inserting direction of the memory card so as to come into contact with a front end of the memory card and to be deformed toward the side of the fixed contact 30*a* when the memory card is inserted.

When the memory card is not inserted into the connector, the movable spring piece 31 returns to an initial state shown in FIG. 12B due to the elastic force thereof, so that the elastic contact portion 31*a* is departed from the fixed contact 30*a*. On the other hand, when the memory card is inserted into the connector, the elastic contact portion 31*a* of the movable spring piece 31 is bent toward the side of the fixed contact 30*a* by the front end of the memory card, so that the elastic contact portion 31*a* and the fixed contact 30*a* contact with each other. By applying a predetermined voltage between the fixed contact plate 30 and the movable spring piece 31, the detection switch comprised of the fixed contact plate 30 and the movable spring piece 31 is turned on/off depending on contact/non-contact of the elastic contact portion 31*a* of the movable spring piece 31 with the fixed contact 30*a*, so that it is possible to detect whether the memory card is inserted or the memory card is not inserted.

The fixed contact plate 30 is formed by pressing a metal thin plate, and the fixed contact 30*a* comes into contact with the elastic contact portion of the movable spring piece 31 at an end face thereof punched out by pressing. The movable spring piece 31 is also formed by pressing a metal thin plate, and the elastic contact portion 31*a* comes into contact with the fixed contact 30*a* at a surface of the metal thin plate as a material thereof. However, the elastic contact portion 31*a* is formed so as to protrude forward from the base member 7 in the inserting direction of the memory card, to be continued to a clank portion 31*b* formed closer to the side of the fixed contact plate 30 in the width direction and to form a predetermined angle with respect to the direction of inserting the memory card. Thus, the position of the elastic contact portion 31*a* with respect to the fixed contact 30*a* is easily affected by working error of the elastic contact portion 31*a* itself, clank portion 31*b* or the like. Thus, when the position of the elastic contact portion 31*a* shifts in the thickness direction of the connector as shown by one dotted chain line in FIG. 12A, there is a problem that the elastic contact portion 31*a* cannot contact with the fixed contact 30*a* and stability of the detection switch cannot be ensured.

Furthermore, in order to manufacture the contact block at low costs, a plurality of the contacts, the fixed contact plate 30 and the movable spring piece 31 are formed so as to be connected to each other via a connecting portion by punching and bending a piece of metal thin plate by pressing, and after insert molding the base member 7 in this state, the connecting portion is cut to separate the contacts, the fixed contact plate 30 and the movable spring piece 31 from each other. Since the contacts, the fixed contact plate 30 and the movable spring piece 31 are formed of the same plate in this manner, their thicknesses are the same.

Hereupon, to ensure strength of the portions which are insert-molded with the base member 7, it is necessary to use a metal thin plate having a certain degree of thickness (for example, 0.2 mm). Thus, the thickness of the elastic contact portion 31*a* becomes thicker more than requires, thereby causing problems that contact pressure between the elastic contact portion 31*a* and the fixed contact 30*a* becomes too high, permanent set occurs in the elastic contact portion 31*a* or a scratch is generated in the memory card that contacts with the elastic contact portion 31*a* when the memory card is inserted.

Besides, tolerance of width dimension of the memory card is ±0.1 mm. Therefore, results of analysis of the contact pressure in the cases where the width dimension of the memory card is +0.1 mm from a reference dimension, equal to the reference dimension and −0.1 mm from the reference dimension are shown FIGS. 13A to 13C.

As the width of the memory card is wider, an amount of bending of the movable spring piece 31 becomes larger, and accordingly the contact pressure between the elastic contact portion 31*a* and the fixed contact 30*a* also increases. When the width of the memory card was equal to the reference dimension, the contact pressure between the elastic contact portion 31*a* and the fixed contact 30*a* was 4.27 N. When the width of the memory card was larger by 0.1 mm than the reference dimension, the contact pressure between the elastic contact portion 31*a* and the fixed contact 30*a* is 4.27 N or more. When the width of the memory card was narrower by 0.1 mm than the reference dimension, the contact pressure between the elastic contact portion 31*a* and the fixed contact 30*a* was 3.56 N. In either case, since the contact pressure between the elastic contact portion 31*a* and the fixed contact 30*a* was too high, stress applied to the movable spring piece 31 became 980 $N/mm^2$ or more, so that weakening (permanent set) occurred in the movable spring piece 31.

DISCLOSURE OF INVENTION

A first object of the present invention is to provide a connector for memory card which can ensure stability in contact even when bending dimension of the movable spring piece varies. A second object of the present invention is to provide a connector for memory card which can prevent bounce-out of the memory card.

In order to achieve the above-mentioned objects, a connector for memory card in accordance with an aspect of the present invention comprises: a box-like housing having a card inserting slot on its front face; a contact block that holds a plurality of contacts coming into contact with terminals provided on a face of a memory card and is disposed in a vicinity of a rear end in said housing so that said contacts face said card inserting slot; a slider that contacts with the memory card inserted into said housing and moves in said housing along an inserting direction of the memory card; and a detection switch that is comprised of a fixed contact plate and a movable spring piece, which are held on said contact block so as to protrude in the inserting direction of the memory card, and detects that the memory card is inserted to a normal position. An inclined plane that is inclined so as to come closer to said fixed contact plate as approaching to its both sides in directions perpendicular to a direction that said fixed contact plate is opposed to said movable spring piece and said inserting direction of the memory card, respectively, is formed on a contact portion of said movable spring piece of said fixed contact plate.

By such a configuration, in spite of positional variation of the movable spring piece, the inclined plane provided on the movable spring piece comes into contact with the fixed contact plate at two points, so that it is possible to stabilize the contact state between the fixed contact and the elastic contact portion.

In addition, by further comprising: a pressing spring for pressing said slider in a direction of taking out the memory card; a push-on and push-off locking mechanism that locks movement of said slider when said slider is moved to a locking position inner than a position at which the terminals of the memory card come into contact with said contacts, and releases the locking of said slider when said slider is moved to a lock releasing position inner than the locking position; and elastic protrusions provided in portions where concave portions for locking formed on the memory card pass while a front end of said slider moves to the initial position after the terminals of the memory card are departed from said contacts when the memory card is taken out, the elastic protrusions engage with the concave portions for locking just before the slider and the memory card return to the initial position, so that it is possible to reduce a force to push out the memory card rapidly and reliably by elastic force of the elastic protrusions. As a result, the bounce-out of the memory card can be prevented.

BRIEF DESCRIPTION OF DRAWINGS

FIGS. 10A to 10C are a plan view, side view and rear view, respectively, showing a configuration of a cover shell in accordance with the second embodiment.

BEST MODE FOR CARRYING OUT THE INVENTION (First Embodiment)

A connector for memory card in accordance with a first embodiment of the present invention will be described in detail with reference to figures. In the following description, the side of a card insertion slot of a housing of the connector is defined as "front" and the side on which contacts are provided is defined as "rear". With respect to the memory card, the side that protrudes from the housing of the connector is defined as "rear" and the side on which terminals and a chamfered portion are formed is defined as "front". In addition, with respect to the housing, the side of a cover shell is defined as "upper" and the side of a base shell is defined as "lower".

Figure 1:
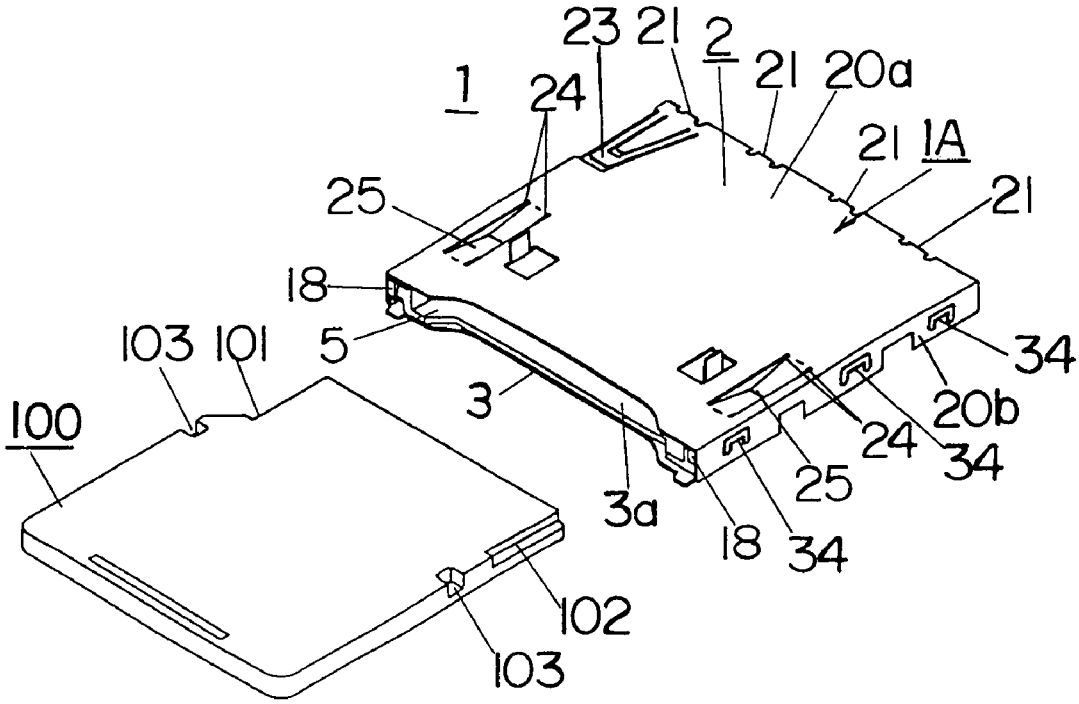
FIG. 1 is a perspective view showing an appearance of a connector for memory card and a memory card connected thereto in accordance with a first embodiment of the present invention.

First, a mini SD card as an example of the memory card will be described briefly. A memory card 100 shown in FIG. 1 is called as the mini SD card, which is a miniaturized version of a conventional SD memory, is shaped as a substantially rectangular flat plate and has a chamfered portion 101 at a corner of a front end thereof (the insertion side). An upward stepped portion 102 is provided at each of right and left side edges of the front end of the memory card 100. Furthermore, a recessed portion 103 for locking recessed substantially in a rectangular shape is provided at each of the right and left side edges on the top face at the rear side (the taking out side) of the chamfered portion 101. Still furthermore, a plurality of terminals 104 is arranged in parallel with each other in the vicinity of the front end on the bottom face of the memory card 100 (refer to FIG. 3).

Subsequently, the detailed configuration of the connector 1 for memory card 1 in accordance with the first embodiment will be described. FIG. 1 is a perspective view showing an appearance of the connector 1 and FIG. 2 is an exploded perspective view showing the configuration of the connector 1.

Figure 2:
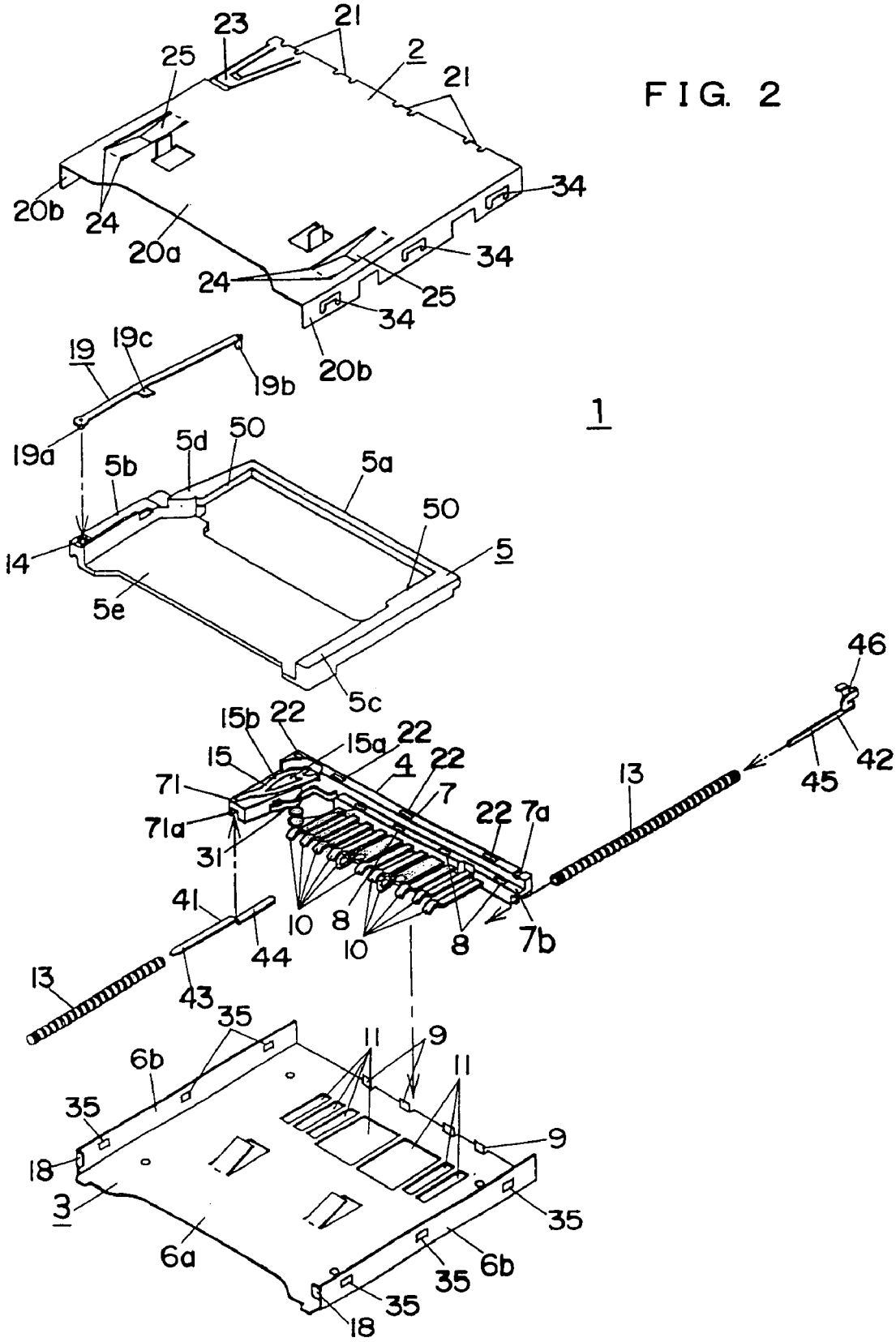
FIG. 2 is an exploded perspective view showing the configuration of the connector for memory card in accordance with the first embodiment.

As shown in FIG. 2, the connector 1 comprises a base shell 3 formed by punching a very thin stainless metal plate by pressing and then bending the plate, and a cover shell 2 formed by punching a very thin stainless metal plate by pressing and then bending the plate in the same way as the base shell 3. A box-like flat housing 1A having a card inserting slot 3*a* on a front face through which the memory card is inserted is constituted by overlaying the cover shell 2 on a top face of the base shell 3. A contact block 4 is mounted in the vicinity of a rear end of and in the housing 1A. A slider 5 formed of a resin molding is arranged in the housing 1A and at a front side of the contract block 4 so as to freely movable in a cross direction (direction of inserting or taking out the memory card 100) in the housing 1A.

A side wall 6*b* formed to be bent upward is provided on each of right and left sides of a bottom plate 6*a* of the base shell 3 and front and rear ends of a bottom plate 6*a* are opened. A plurality of protrusions 9 is formed to be bent upward at the rear end of the bottom plate 6*a*. By press-fitting these protrusions 9 into press-fit holes 8 formed on a base member 7 made of resin of the contact block 4 so as to be penetrated from below, the contact block 4 is fixed at a rear portion on the top face of the bottom plate 6*a* of the base shell 3. Furthermore, a plurality of engaging holes 35 . . . is formed to be penetrated through at each of the side walls 6*b*. Still furthermore, a convex portion 18 is formed to be protruded inward at the front end of each side wall 6*b* so as to prevent falling of the slider 5 from the card insertion slot 3*a*. Still furthermore, a plurality of penetrating holes 11 . . . for letting out the contacts 10 . . . is formed at portions of the bottom plate 6*a* opposing to the contacts 10 . . . held on the contact block 4 so as not to contact the contacts 10 with the bottom plate 6*a* when the contacts 10 are pushed downward by the memory card 100.

A side wall 20*b* formed to be bent downward is provided on each of right and left sides of a top plate 20*a* of the cover shell 2, and front and rear ends of the top plate 20*a* are opened. A plurality of protrusions 21 is formed to be bent downward at the rear end of the top plate 20*a*. When the cover shell 2 is overlaid on the base shell 3, the contact block 4 is fixed on the housing 1A comprised of the cover shell 2 and the base shell 3 by press-fitting these protrusions 21 into press-fit holes 22 formed on the base member 7 of the contact block 4 made of resin and disposed at the rear portion on the top face of the base shell 3 from above. Furthermore, elastic engaging portions 34 . . . are formed by cutting and bending upward the both side walls 20 at positions corresponding to the engaging holes 35 . . . on the both side walls 6*b* of the base shell 3.

Still furthermore, two slits 24 and an elastic protrusion 25 formed by protruding a portion disposed between the slits 24 downward are provided in the vicinity of each of right and left ends of the top plate 20*a*. The elastic protrusions 25 are provided so as to be opposed to portions where the recessed portions 103 for locking formed on the memory card 100 pass while the slider 5 moves to an initial position at front end after departing the terminals 104 of the memory card 100 from the contacts 10, when the memory card 100 is taken out from the connector 1. Thus, the elastic protrusions 25 come into contact with the top face (a face opposite to the face on which the terminals 104 are formed) of the memory card 100, thereby pressing the memory card 100 against the slider 5. When the recessed portions 103 for locking pass below the elastic protrusions 25, the elastic protrusions 25 fit to the recessed portions 103 for locking, thereby reducing moving speed of the memory card 100 or stopping movement of the memory card 100.

Figure 3:
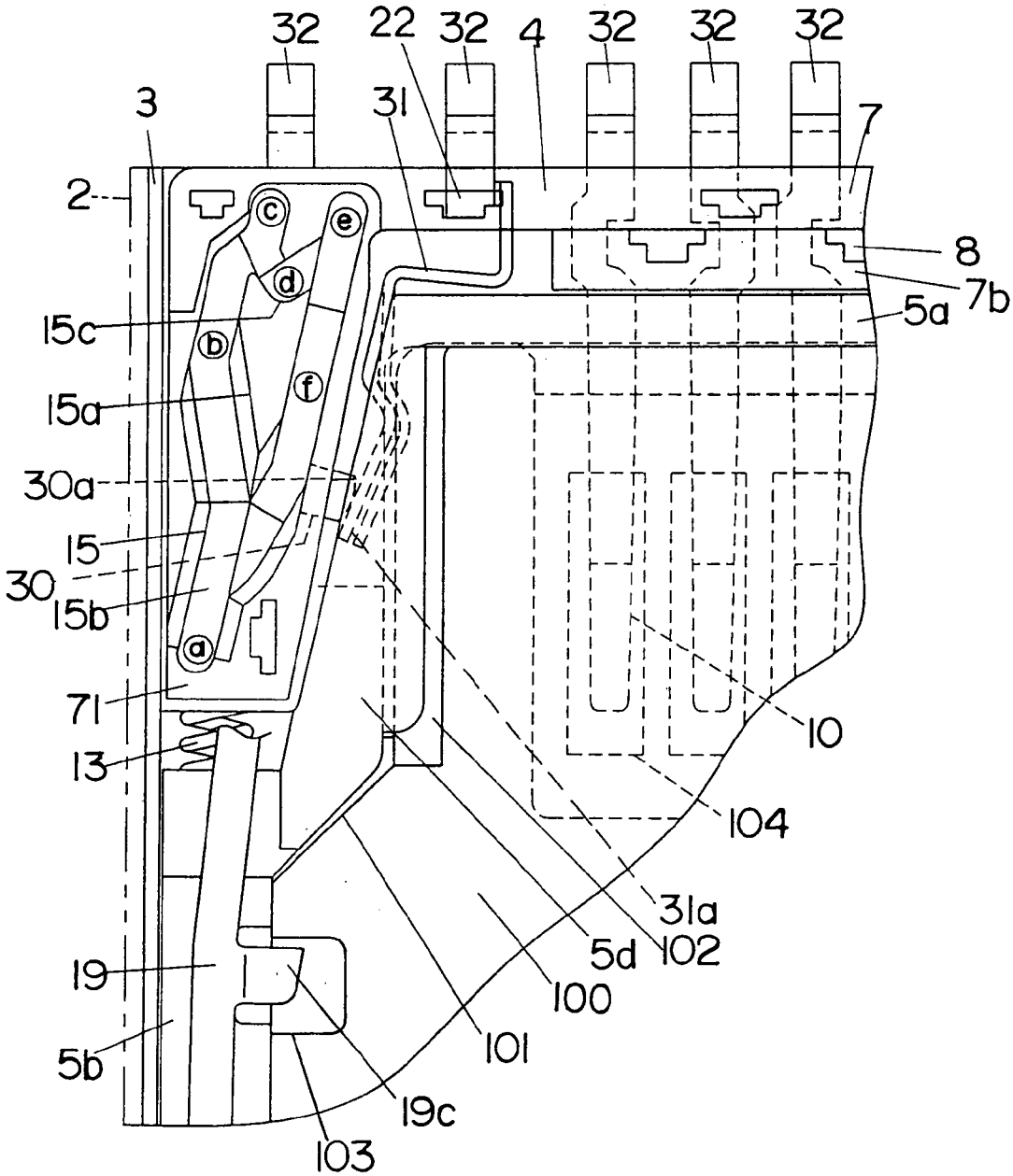
FIG. 3 is an enlarged view of a principal part showing a condition that a cover shell is removed in the connector in accordance with the first embodiment.
Figure 4C:
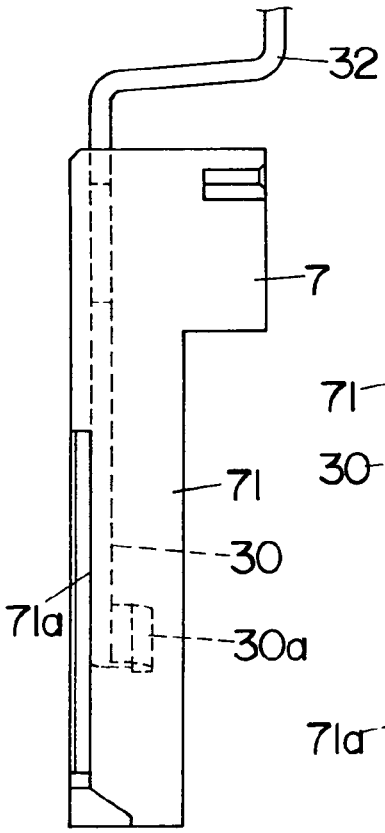
FIGS. 4A to 4D are a front view, plan view, side view and front sectional view, respectively, showing a detection switch portion in a contact block of the connector for memory card in accordance with the first embodiment.
Figure 4B:
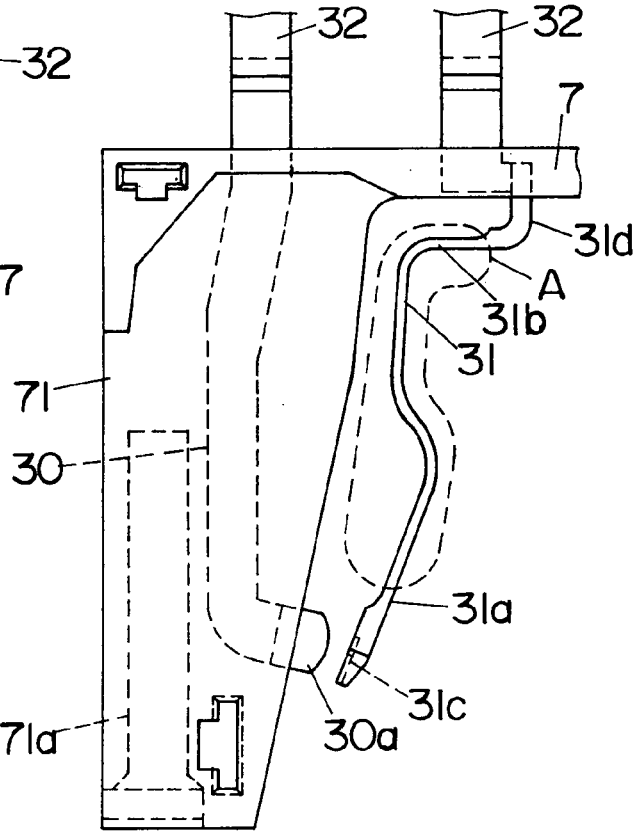
Figure 4D:
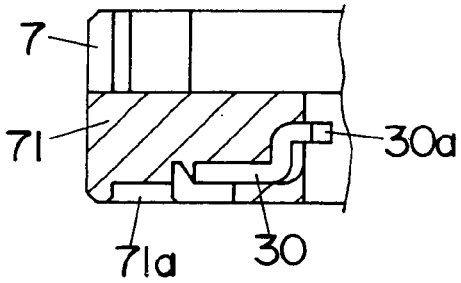
Figure 4A:
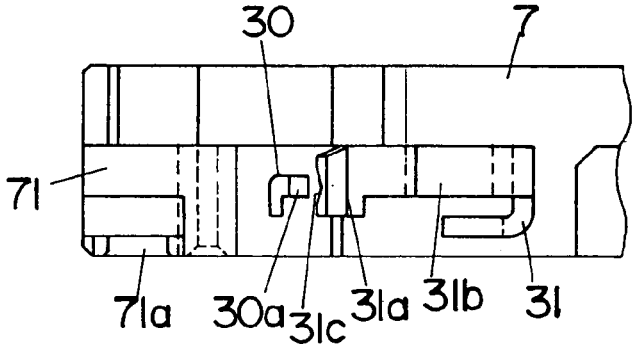
Figure 5A:
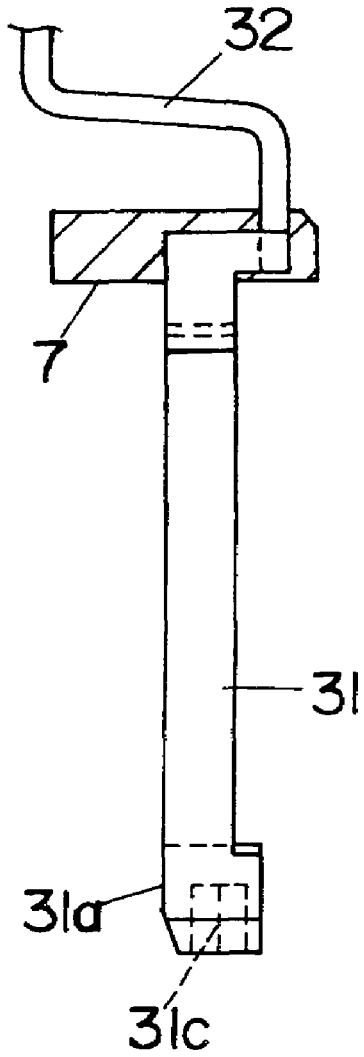
FIG. 5A is a side view showing a configuration of a movable spring piece in accordance with the first embodiment.
Figure 5B:
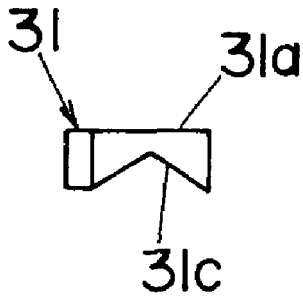
FIG. 5B is a front view showing a shape of a contact portion of the movable spring piece which contacts with a fixed contact plate.

The contact block 4 comprises the contacts 10 . . . respectively contacting with a plurality of the terminals 104 arranged in the vicinity of the front end on the bottom face of the memory card 100, a fixed contact plate 30 and a movable spring piece 31 for detecting position of the memory card 100. The contacts 10 . . . , the fixed contact plate 30 and the movable spring piece 31 are integrally held on the base member 7 made of resin by insert molding. As shown in FIG. 3, contact portions of the contacts 10 . . . , the fixed contact plate 30 and the movable spring piece 31 are respectively protruded forward of the base member 7 (the side of the card insertion slot 3*a*) and soldering terminals 32 . . . to be soldered on a circuit board or the like are protruded backward of the base member 7.

As shown in FIG. 2, a stepped portion 7*b* is provided on the front face of the base member 7. The above-mentioned press-fit holes 8 . . . are formed so as to penetrate the stepped portion 7*b* of the base member 7 in a vertical direction. Furthermore, the press-fit holes 22 are formed at the rear side on the top face of the stepped portion 7*b*. A protrusion 71 protruding toward to the front face side is provided integrally with an end of the base member 7 in the longitudinal direction. A heart cam groove portion 15 is further formed on the top face of the protrusion 71. The heart cam groove portion 15 is comprised of a heart cam 15*a* and a guide groove 15*b* formed around the heart cam 15*a*, and a guide shaft 19*b* of a locking attachment 19 is slidably engaged in the guide groove 15*b*. As shown by marks "a" to "f" in FIG. 3, a bottom face of the guide groove 15*b* is comprised of six portions which are different from each other in elevation and is configured so that the guide shaft 19*b* of the locking attachment 19 moves in the guide groove 15*b* along a predetermined route following to forward and backward movement of the slider 5. In addition, a pressing spring portion 23 is formed on the top plate 20*a* of the cover shell 2 by cutting and bending a portion opposing to the heart cam part 15. The guide shaft 19*b* of the locking attachment 19 is pressed against the bottom face of the guide groove 15*b* by the pressing spring portion 23. The heart cam groove portion 15 and the locking attachment 19 constitute a push-on and push-off locking mechanism. This push-on and push-off locking mechanism locks the movement of the slider 5 and the memory card 100 engaged therewith in the direction of taking out when the slider 5 is pressed up to a locking position inner than the position at which the terminals 104 of the memory card 100 come into contact with the contacts 10, and releases the locking of the slider 5 when the slider 5 is pressed up to a position further inner than the locking position to make the slider 5 and the memory card 100 engaged therewith movable in the direction of taking out.

The slider S has arm portions 5*b* and 5*c* for guiding the right and left side edges of the memory card 100, a contact portion 5*a* that connects between the rear parts of the upper side edges of the arm portions 5*b* and 5*c* and contacts with the front end on the upper face of the memory card 100 and a plate-like connecting portion 5*e* that connects between the front parts of the lower side edges of the arm portions 5*b* and 5*c*, and these components are formed integrally by resin molding. A projecting portion 5*d* that contacts with the chamfered portion 101 of the memory card 100 is provided at the rear part of the arm portion 5*b* on the left side of the slider so as to protrude inward. Furthermore, a shaft hole 14 for pivoting a rotation shaft 19*a* of the locking attachment 19 is formed at the front end on the top face of the arm portion 5*b* on the left side of the slider 5. Each of the arm portions 5*b* and 5*c* serves to guide the right and left side of the memory card 100, a stepped portion 50, an upper side of which is protruded inwardly larger than a lower side thereof, is provided at the inner side face of the rear part of each of the arm portions 5*b* and 5*c*, and the upward stepped portions 102 formed on the right and left side edges of the memory card 100 each enter into the downside of the stepped portions 50 of the arm portions 5*b* and 5*c*, respectively. Since a bottom face of the contact portion 5*a* is located above a top face of the connecting portion 5*e*, a gap is formed between the bottom face of the contact portion 5*a* and the top face of the bottom plate 6*a* of the base shell 3. Thus, when the slider 5 is pressed, the contacts 10 . . . pass below the contact portion 5*a* and protrude further forward than the contact portion 5*a*.

The locking attachment 19 is formed by punching a narrow metal plate in the substantially dog-legged shape when viewed in plan, the above-mentioned guide shaft 19*b* is provided at an end thereof and the above-mentioned rotation shaft 19*a* is provided at the other end thereof. Furthermore, a locking portion 19*c* that protrudes sideways is formed integrally with an inner edge, (side edge at the side of the memory card 100) of a bent part of the locking attachment 19. Since the guide shaft 19*b* of the locking attachment 19 is slidably engaged in the guide groove 15*b* of the heart cam groove portion 15 formed at the protrusion 71 of the base member 7 of the contact block 4 on one hand and the rotation shaft 19*a* is pivoted by the shaft hole 14 of the arm portion 5*b* of the slider 5 on the other hand, the guide shaft 19*b* moves around the heart cam 15*a* following to forward and backward movement of the slider 5 while being guided by the side wall and the bottom face having varied elevation of the guide groove 15*b*. At that time, the locking attachment 19 is swung around the rotation shaft 19*a* and the locking portion 19*c* moves from side to side according to the swing of the locking attachment 19.

A groove (not shown) opened at the side of the end face, into which a front end of a coil spring (pressing spring) 13 is inserted, is formed on each of the lower side faces of the arm portions 5*b* and 5*c* of the slider 5. Each of rear ends of the coil springs 13 is attached to the contact block 4 via spring seat pieces 41 and 42, respectively. A spring seat holding groove 71*a* is formed on the bottom face of the protrusion 71 of the base member 7 of the contact block 4. One spring seat piece 41 has an anti-buckling needle 43 that prevents buckling of the coil spring 13 by being inserted into the coil spring 13 from behind, and an attaching portion 44 that is continuously extended from a rear end of the anti-buckling needle 43 and engaged in the spring seat holding groove 71*a* of the protrusion 71. The other spring seat piece 42 has an anti-buckling needle 45 that prevents buckling of the coil spring 13 by being inserted into the coil spring 13 from behind, and an attaching portion 46 that is extended from a rear end of the anti-buckling needle 45 and engaged in a connecting groove 7*a* provided at the right end of the base member 7. Hereupon, since the arm portions 5*b* and 5*c* receive pressing force by the coil springs 13 equally, the slider 5 can smoothly slide in the housing 1A in the cross direction.

Figure 6:
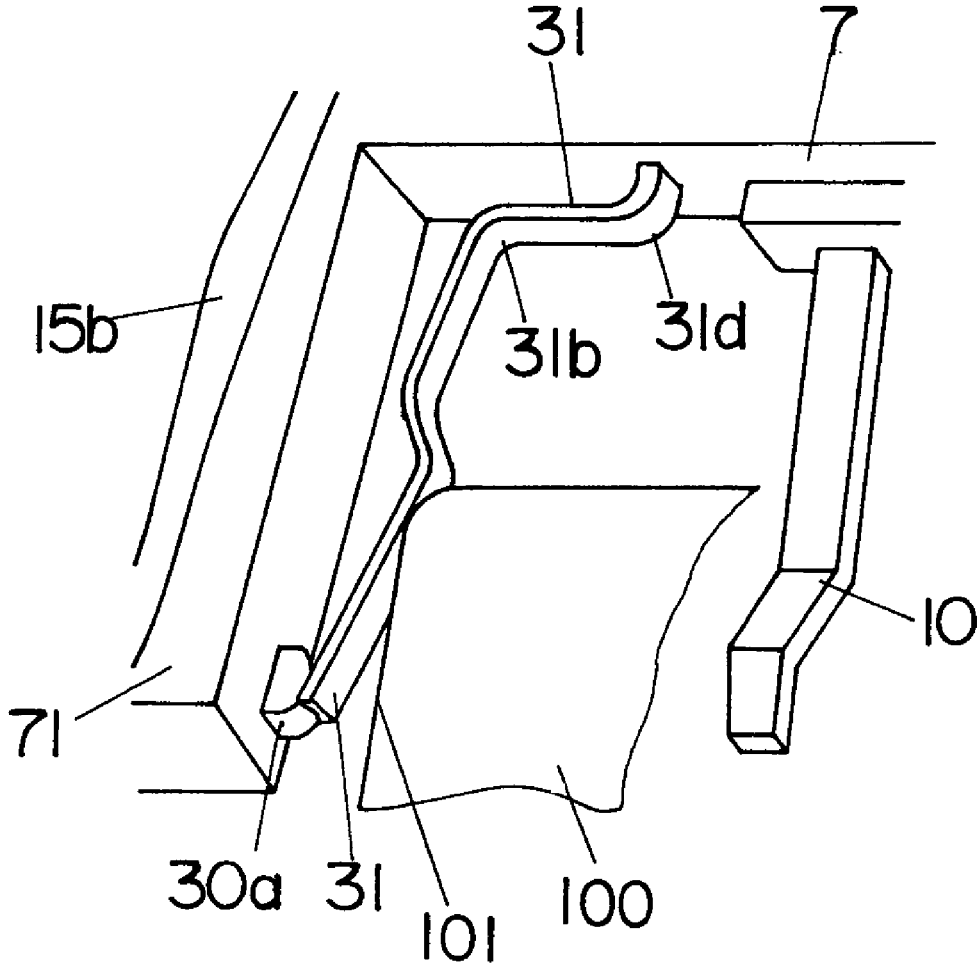
FIG. 6 is a perspective view showing a state that the memory card contacts with the fixed contact plate with bending the movable spring piece.

By the way, a detection switch for detecting that the memory card 100 is inserted is provided on base member 7 of the contact block 4, and the detection switch is comprised of the fixed contact plate 30 and the movable spring piece 31. As shown in FIGS. 4A to 4D, the fixed contact plate 30 is held on the protrusion 71 of the base member 7 by insert molding, and a fixed contact 30*a* formed at the front end of the fixed contact plate 30 is exposed inward from the protrusion 71. On the other hand, the movable spring piece 31 is formed so as to protrude forward from the base member 7, and has a crank portion 31*b* formed at the side closer to the base member 7 and an elastic contact portion 31*a* formed in succession to the crank portion 31*b*. The crank portion 31*b* is protruded from a base portion 31*d* held on the base member 7 in the inserting direction of the memory card and bent in a shape of a crank so that the elastic contact portion 31*a* comes closer to the fixed contact plate 30. As shown in FIG. 6, when the memory card 100 is inserted, the elastic contact portion 31*a* is formed at a predetermined angle with respect to the inserting direction of the memory card 100 so as to come into contact with the front end of the memory card 100 and bend toward the side of the fixed contact 30*a*. A vicinity of the front end of the elastic contact portion 31*a* is opposed to the fixed contact 30*a*, and the crank portion 31*b* is curved so as to protrude in the direction opposite to the fixed contact 30*a*.

As shown in FIG. 4A, FIG. 4B, FIG. 5A and FIG. 5B, a groove 31*c* having a substantially V-shaped cross section is formed at a contacting portion of the elastic contact portion 31*a* of the movable spring piece 31 with the fixed contact 30*a*, and the groove 31*c* has an inclined plane that becomes inclined so as to come closer to the fixed contact 30*a* as it gets nearer to both of its side parts in the vertical direction. By such a configuration, when the fixed contact 30*a* comes into contact with the elastic contact portion 31*a*, the fixed contact 30*a* contacts the inclined plane of the groove 31*c*. The fixed contact plate 30 is formed by pressing a metal thin plate, and the end face of the fixed contact 30*a* punched by pressing comes into contact with the elastic contact portion 31*a* of the movable spring piece 31. Thus, even when position of the elastic contact portion 31*a* varies slightly in the vertical direction due to working error of the elastic contact portion 31*a* or the crank portion 31*b*, an upper or lower edge of the end face of the fixed contact 30*a* slides relatively on the inclined plane of the groove 31*c* and position of the elastic contact portion 31 accomplishes small movements in the vertical direction so that the upper and lower edges of the end face of the fixed contact 30*a* come into contact with the inclined plane of the groove 31*c* at two points. Thus, stable contact between the fixed contact 30*a* and the elastic contact portion 31*a* can be obtained.

In this embodiment, although the groove 31*c* having a substantially V-shaped cross section is formed at the contact area of the elastic contact portion 31*a* with the fixed contact 30*a*, sectional shape of the groove 31*a* is not limited to the substantially V-shape and it should be a configuration that the fixed contact 30*a* and the elastic contact portion 31*a* can contact with each other at two points. It is sufficient to have an inclined plane, such as a groove having a substantially arc-shaped cross section or substantially U-shaped cross section, that becomes inclined so as to come closer to the fixed contact plate 30 as approaching to its both sides in the directions perpendicular to respective of the direction that the fixed contact plate 30 is opposed to the movable spring piece 31 and the direction of inserting the memory card 100.

The movable spring piece 31 is formed by applying pressing, punching and bending to a metal plate having a thickness of 0.2 mm together with the contacts 10 . . . and the fixed contact plate 30. Thus, unless the movable spring piece 31 is subjected to additional working, the thickness of it becomes the same as those of the contacts 10 . . . and the fixed contact plate 30. In this embodiment, prior to insert molding of the base member 7, a middle area (area represented by a mark A in FIG. 4B) except at least the contact area with the fixed contact 30*a* and the base portion 31*d* held by the base member 7 among the movable spring piece 31 is subjected to pressing so as to be thinner to be about a half thickness of the base portion 31*d* requiring some strength and the contact area with the fixed contact 30*a* influencing no contact pressure, that is, to have a thickness (about 0.1 mm) causing no permanent set when the memory card is inserted. As a result, occurrence of the permanent set can be prevented by impairing spring property of the movable spring piece 31 to lower contact pressure and decreasing pressure applied to the movable spring piece 31 in inserting the memory card.

Figure 7A:
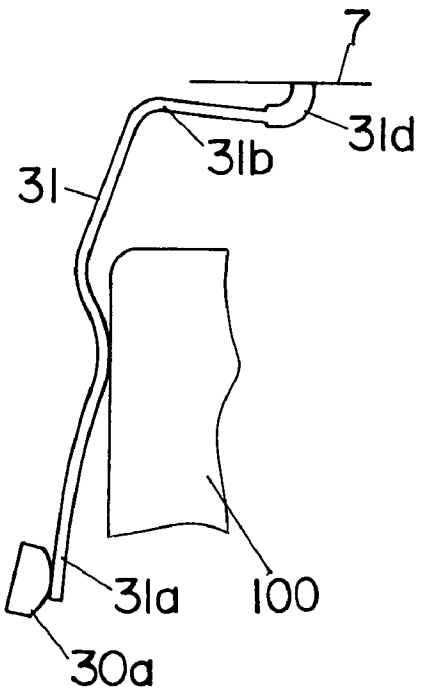
FIGS. 7A to 7C are drawings respectively showing analysis results of contact pressure in the cases where width dimension of the memory card is +0.1 mm from a reference dimension, equal to the reference dimension and −0.1 mm from the reference dimension in the connector for memory card in accordance with the first embodiment.
Figure 7B:
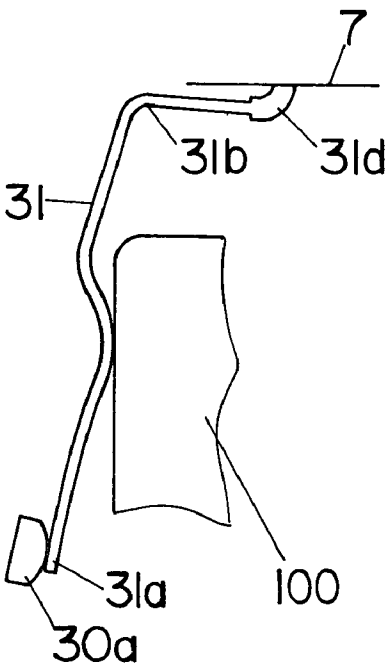
Figure 7C:
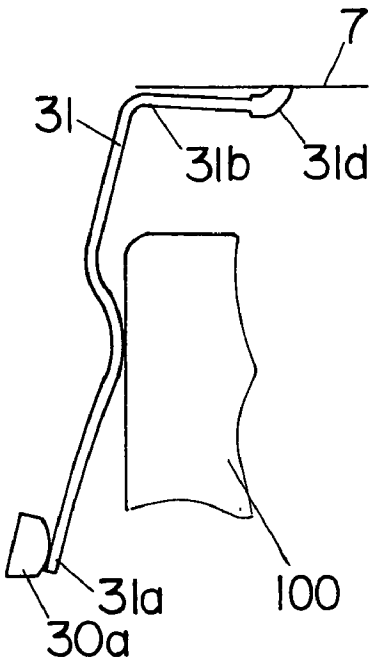
Figure 8:
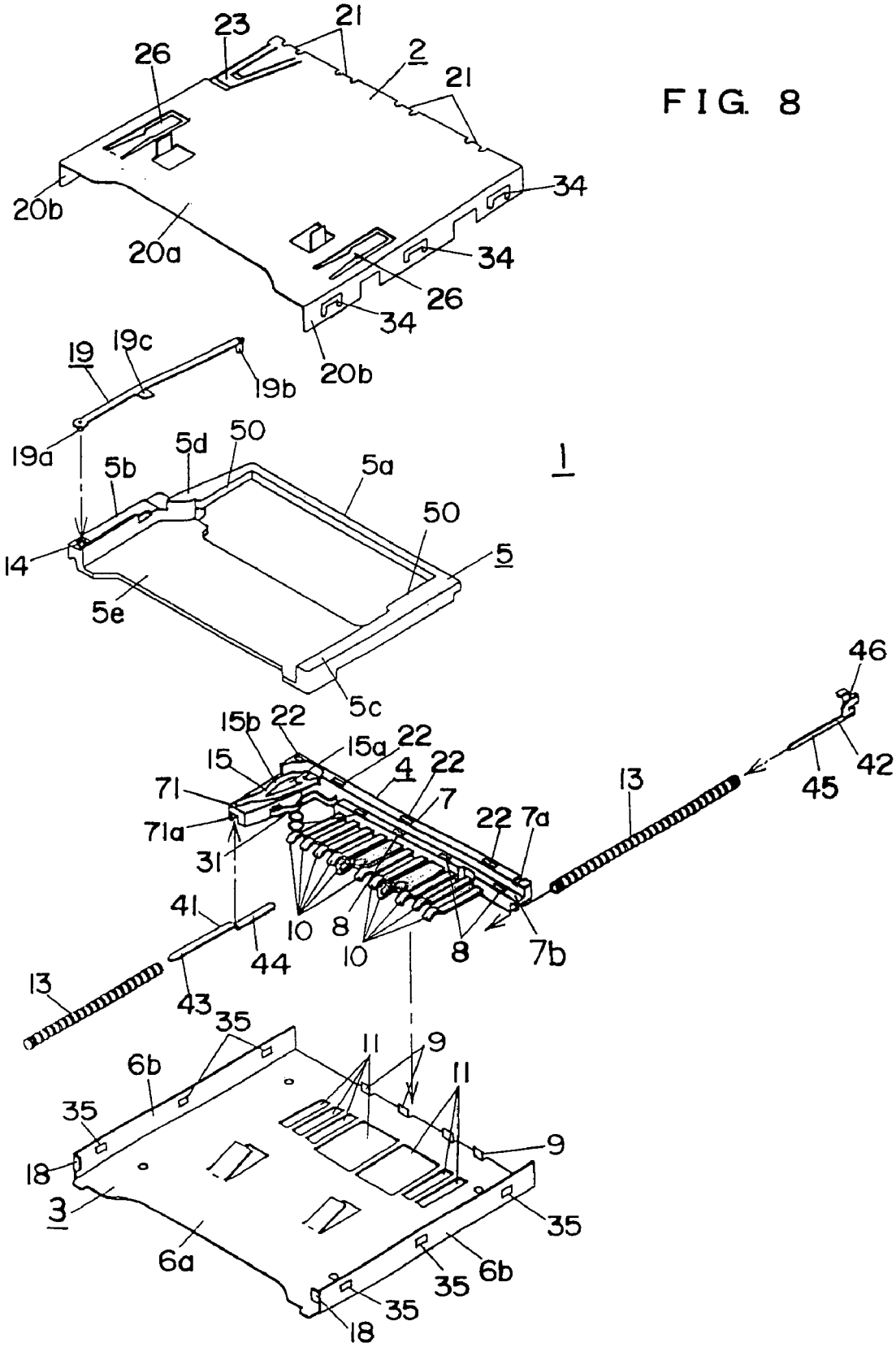
FIG. 8 is an exploded perspective view showing a configuration of a connector for memory card in accordance with a second embodiment of the present invention.
Figure 9:
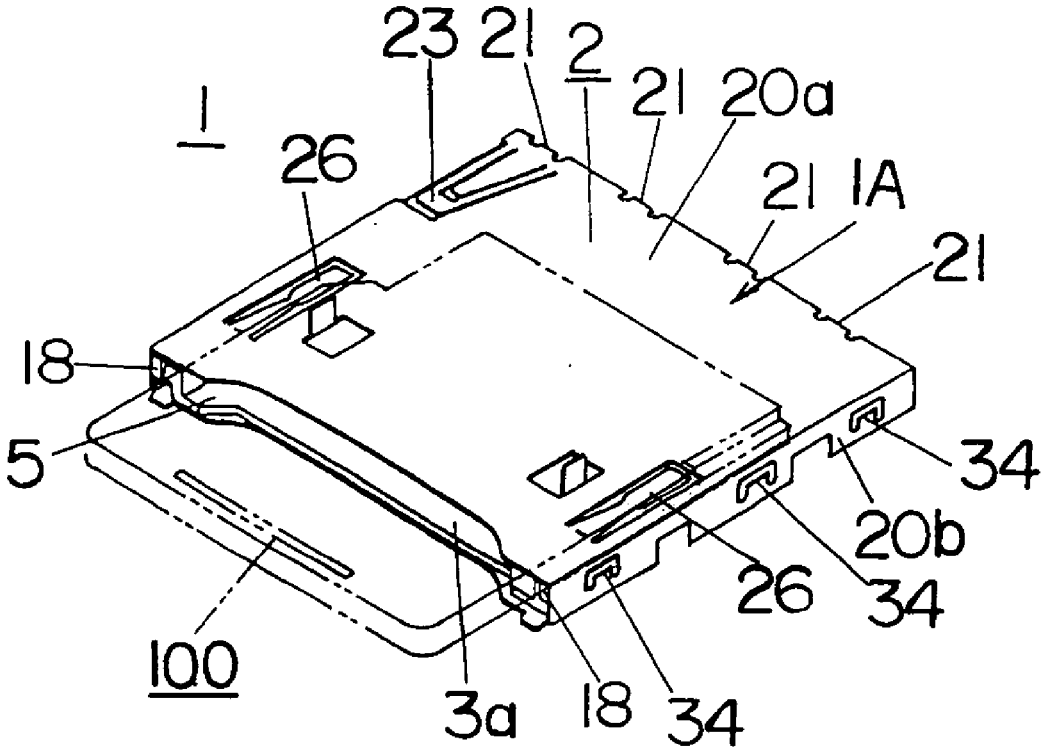
FIG. 9 is a perspective view showing an appearance of the connector for memory card in accordance with the second embodiment.
Figure 11:
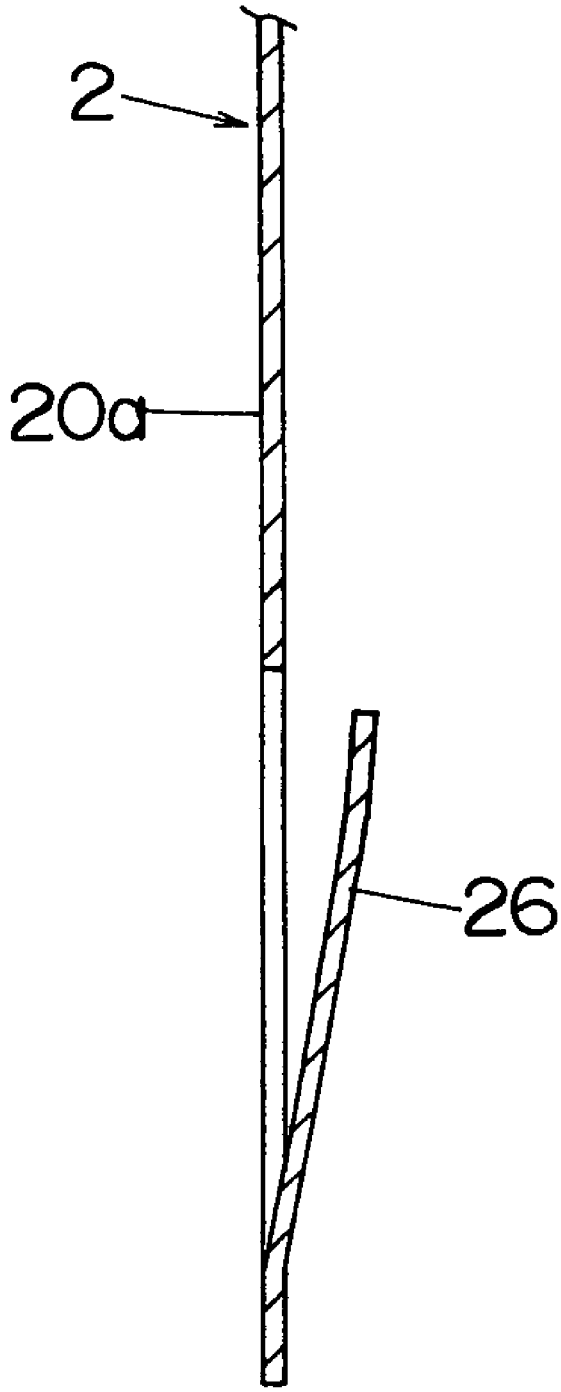
FIG. 11 is an X—X cross-sectional view in FIG. 10A.
Figure 12C:
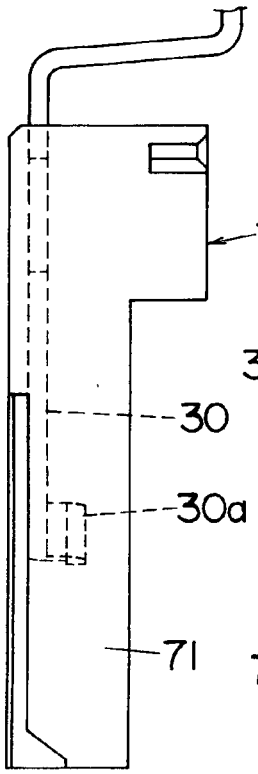
(PRIOR ART) FIG. 12C
FIGS. 12A to 12D are a front view, plan view, side view and side sectional view, respectively, showing a detection switch portion in a contact block of a conventional connector for memory card.
Figure 12B:
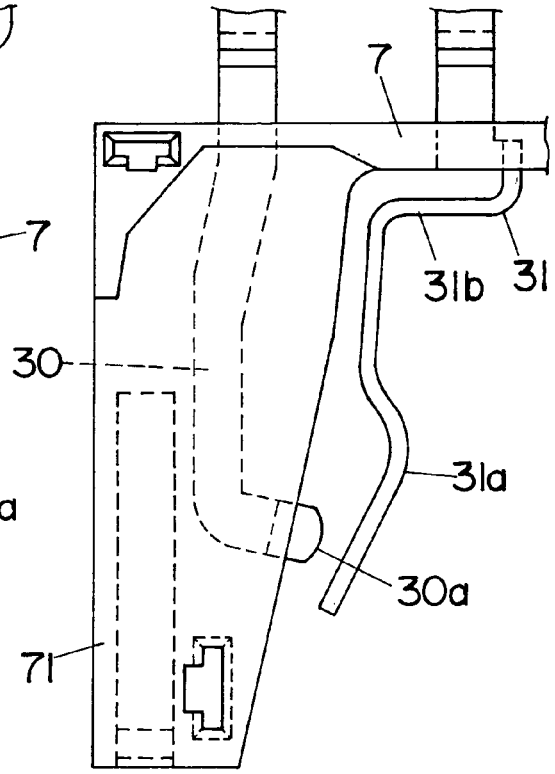
Figure 12D:
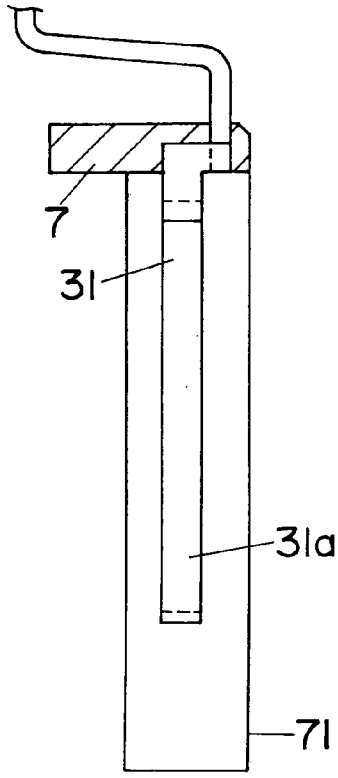
Figure 12A:
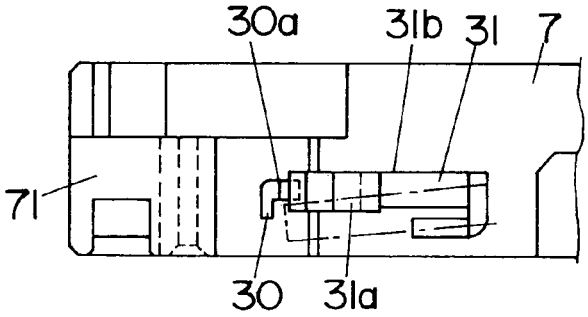
Figure 13A:
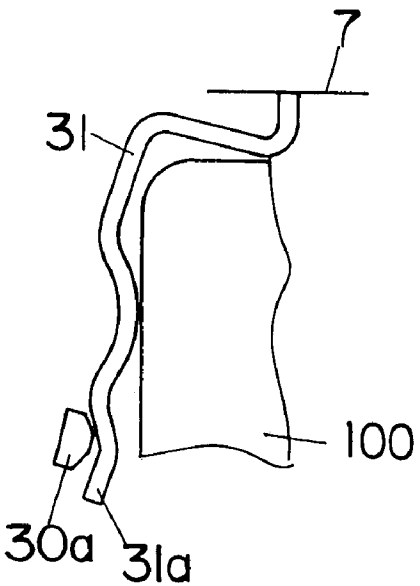
(PRIOR ART) FIG. 13A
FIGS. 13A to 13C are drawings respectively showing analysis results of contact pressure in the cases where width dimension of the memory card is +0.1 mm from a reference dimension, equal to the reference dimension and −0.1 mm from the reference dimension in the conventional connector for memory card.
Figure 13B:
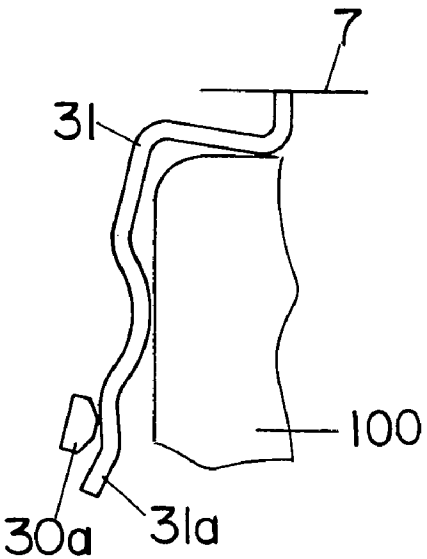
Figure 13C:
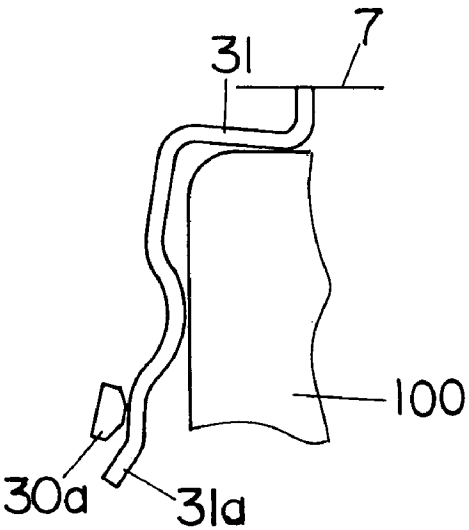

FIGS. 7A to 7C show analysis results of contact pressure in the cases where width dimension of the memory card 100 is +0.1 mm from a reference dimension, equal to the reference dimension and −0.1 mm from a reference dimension. As the memory card is wider, bending amount of the movable spring piece 31 becomes larger. When the width of the memory card is equal to the reference dimension, the contact pressure between the elastic contact portion 31*a* and the fixed contact 30*a* is 0.21 N. When the width of the memory card is wider by 0.1 mm than the reference dimension, the contact pressure between the elastic contact portion 31*a* and the fixed contact 30*a* is 0.28 N. When the width of the memory card is narrower by 0.1 mm than the reference dimension, the contact pressure between the elastic contact portion 31*a* and the fixed contact 30*a* is 0.15 N. When the width of the memory card is the largest, the contact pressure between the elastic contact portion 31*a* and the fixed contact 30*a* is less than one twentieth of the conventional value. As a result, since the pressure applied to the movable spring piece 31 is decreased up to 847 $N/mm^2$, which is less than elastic limit (=980 $N/mm^2$), no permanent set occurs.

Besides, in order to reduce the pressure applied to the movable spring piece 31, it can be considered that the movable spring piece 31 is formed of another plate material thinner than the plate material forming the contacts 10 . . . and fixed contact plate 30. In such a case, however, the operation of insert molding becomes difficult, thereby causing a factor in cost increase. On the contrary, in this embodiment, since the contact block 4 is formed in the above-mentioned manner, insert molding is easy, causing no cost increase.

Subsequently, assembling procedure of the above-mentioned connector for memory card 1 will be described. The spring seat piece 41 is attached to the base member 7 of the contact block 4 into which the contacts 10, the fixed contact plate 30 and the movable spring piece 31 are inserted. Then, the contact block 4 is disposed on the rear part on the top face of the base shell 3 and the protrusions 9 . . . formed on the base shell 3 are press-fitted into the press-fit holes 8 of the contact block 4 from below for fixing the contact block 4 on the base shell 3. Subsequently, the slider 5 is disposed on the front part on the top face of the base shell 3 in a manner so that the rear part of the left coil spring 13 is inserted into the spring seat piece 41 and the front end of the coil spring 13 is fitted in the groove provided on the bottom face of the arm portion 5*b*. After that, the rotation shaft 19*a* at one end of the locking attachment 19 is inserted into the shaft hole 14 of the arm portion 14 to be pivoted by the shaft hole 14 and the guide shaft 19*b* at the other end of the locking attachment 19 is slidably engaged in the guide groove 15*b*. Under such a state, the slider 5 is pressed by the coil spring 13 to be pushed forward (the side of the card inserting slot 3*a*) and the front ends of the arm portions 5*b* and 5*c* contact a back face of the convex portion 18 provided at the front end of the base shell 3, thereby suppressing bounce-out of the slider 5 from the front face of the base shell 3.

After disposing the contact block 4 and the slider 5 on the base shell 3 and mounting the left coil spring 13 and the locking attachment 19, the cover shell 2 is overlaid on the base shell 3 from above. At that time, the protrusions 21 . . . formed on the cover shell 2 are press-fitted into the press-fit holes 22 of the base member 7 of the contact block 4 from above and both of the side walls 20*b* are hanged down so as to be along the outer side faces of the both side walls 6*b* of the base shell 3. The upward front ends of the elastic engaging portions 34 . . . provided on the both side walls 20*b* of the base shell 3 are hooked in the hooking holes 35 . . . provided on the both side walls 6*b*. Thereby, the base shell 3 and the cover shell 2 are coupled with each other so that the box-like flat housing 1A is formed. After that, the right coil spring 13 and the spring seat piece 42 are mounted so that the connector 1 is completed.

The connector 1 in accordance with this embodiment is a connector SMD-type connector in which bottom faces of the soldering terminals 32 . . . of the contacts 10 . . . , the fixed contact plate 30 and the movable spring piece 31 are lowered. Furthermore, by grounding the housing 1A of a metal, it becomes resistant to static electricity and external noise.

Subsequently, operation of each portion at the time when the memory card 100 is inserted into the connector 1 will be described. In the state where the memory card 100 is not inserted, the slider 5 is moved at the side of the card inserting slot 3*a* due to receiving the elastic force of the coil springs 13. At this time, the guide shaft 19*b* of the locking attachment 19 is located at an initial position represented by a mark "a" in FIG. 3. Since the initial position represented by the mark "a" is located at the outermost position in the guide groove 15*b* (the side opposite to the memory card 100), the locking attachment 19 rotates around the rotation shaft 19*a* counterclockwise to the maximum and the locking portion 19*c* is withdrawn at a position where it does not engage in the recessed portion 103 for locking of the memory card 100.

Subsequently, when the memory card 100 is inserted into the card inserting slot 3*a* of the housing 1A in normal directions in the cross direction and the vertical direction, the front end of the memory card 100 is inserted between the both arm portions 5*b* and 5*c* of the slider 5 and the upward stepped portions 102 at both sides on the bottom face of the memory card 100 contact the stepped portions 50 of the arm portions 5*b* and 5*c* of the slider 5. Furthermore, when the memory card 100 is inserted into the housing 1A, the chamfered portion 101 formed on one side of the front end of the memory card 100 engages with the projecting portion 5*d* of the slider 5 and the front end of the memory card 100 is engaged with the contact portion 5*a*. Then, the slider 5 receives pressing force through the memory card 100 and starts to move backward. When the memory card 100 is further inserted against elastic force of the coil springs 13 applied to the slider 5, the slider 5 moves backward following to the insertion of the memory card 100.

Due to the backward movement of the slider 5, the guide shaft 19*b* of the locking attachment 19 moves to a position represented by a mark "b" in the left guide groove 15*b* of the heart cam groove portion 15 while being guided by the guide groove 15*b* in the guide groove 15*b* of the heart cam groove portion 15. At that time, following to the movement of the guide shaft 19*b*, the locking attachment 19 rotates around the rotation shaft 19*a*. However, since the left guide groove 15*b* of the heart cam 15*a* extends substantially straight in the cross direction, the inclination of the locking attachment 19 is sufficiently small and the locking portion 19*c* does not engage in the recessed portion 103 for locking of the memory card 100.

When the memory card 100 is further inserted and moved to a position closer to the position at which the rear face of the contact portion 5*a* of the slider 5 contacts the front face of the base member 7 of the contact block 4, the guide shaft 19*b* of the locking attachment 19 reaches a position at the rear end of the guide groove 15*b*, which is represented by a mark "c", thereby it becomes impossible further to insert the memory card 100. When the pressing force applied to the memory card 100 is removed at this position, the slider 5 together with the memory card 100 attempt to return forward by the elastic force of the coil springs 13. At that time, the guide shaft 19*b* of the locking attachment 19 moves with being guided by the guide groove 15*b* and engages in a recessed portion 15*c* of the heart cam 15*a*, which is represented by a mark "d". As a result, the movement of the slider 5 in the direction of taking out is suppressed any more and the slider 5 remains at the locking position, and the memory card 100 also remains at the position in the housing 1A.

When the front end of the memory card 100 moves to a predetermined position, each of the contacts 10 . . . sequentially comes into contact with the corresponding terminal 104 formed on the bottom face of the memory card 100 depending on length of the contacts 10 . . . . As shown in FIG. 6, the elastic contact portion 31*a* of the movable spring piece 31 protruding forward is pushed by the side face of the chamfered portion 101 of the memory card 100 and contacts with the fixed contact 30*a*, and thereby the detection switch turns on. With using a signal output from the detection switch, it is possible to detect that the memory card 100 has been inserted at the normal position by an external detecting circuit (not shown).

As described above, in the state where the memory card is held, the movement of the slider 5 in the direction of taking out is suppressed by engaging the guide shaft 19*b* of the locking attachment 19 in the recessed portion 15*c* of the heart cam 15*a*. There, however, is a possibility that the memory card 100 may drop from the housing 1A as it is. Thus, in this embodiment, when the slider 5 moves to the locking position, the locking attachment 19 rotates following to forward and backward movement of the slider 5, the rocking portion 19*c* of the locking attachment 19 protrudes more inwardly (the side of the memory card 100) than the arm portion 5*b* of the slider 5, and the front end of the locking portion 19*c* engages in the recessed portion 103 for locking of the memory card 100. As a result, the memory card 100 is locked, and thereby prevented from being dropped from the housing 1A. At this time, since the elastic protrusions 25 contact against the top face of the memory card 100 and press the memory card 100 toward the slider 5, the contact pressure between the terminals 104 of the memory card 100 and the contacts 10 can be ensured.

In order to take the memory card 100 from the connector, the rear end of the memory card 100 that protrudes outward from the card inserting slot 3*a* of the housing 1A is pushed in the inserting direction, thereby moving the memory card 100 with the slider 5 in the inserting direction. Following to this movement, the guide shaft 19*b* of the locking attachment 19 detaches from the recessed portion 15*c* of the heart cam 15*a* and moves to a position in the guide shaft 15*b* on the right side of the recessed portion 15*c*, which is represented by a mark "e", with being guiding by the guide groove 15*b*. At this time, the locking attachment 19 rotates around the rotation shaft 19*a* clockwise and the locking portion 19*c* is moved closer to the memory card 100, so that almost whole of the locking portion 19*c* proceeds into the recessed portion 103 for locking.

After that, when the pressing force to the memory card 100 is released, the slider 5 and the memory card 100 engaged therewith start to move in the forward direction due to the elastic force of the coil springs 13. Following to this movement, the guide shaft 19*b* of the locking attachment 19 moves forward through a position in the right guide groove 15*b* of the heart cam 15*a*, which is represented by a mark "f", while being guided by the guide groove 15*b*. At that time, the locking attachment 19 rotates around the rotation shaft 19*a* counterclockwise and the locking portion 19*c* retracts from the recessed portion 103 for locking. Then, when the slider 5 moves to the side of the card inserting slot 3*a* and returns to the initial position represented by the mark "a" due to the elastic force of the coil springs 13, the locking portion 19*c* comes out of the recessed portion 103 for locking completely, so that locking of the memory card 100 is released. At this time, since the rear end of the memory card 100 protrudes greatly from the card inserting slot 3*a* of the housing 1A, the memory card 100 can be taken from the housing 1A.

On the top plate 20*a* of the cover shell 2, the elastic protrusions 25 are provided at the regions where the recessed portions 103 for locking pass while the slider 5 moves to the initial position at the front end after departing the terminals 104 of the memory card 100 from the contacts 10 when the memory card 100 is taken out. Thus, the elastic protrusions 25 come into contact with the top face of the memory card 100 so as to apply the brake due to friction during the movement of the slider 5 and the memory card 100 in the cross direction. Furthermore, since the elastic protrusions 25 engage in the recessed portions 103 for locking just before the slider 5 and the memory card 100 return to the initial position, it is possible to reduce a force to push out the memory card 100 rapidly and reliably by elastic force of the elastic protrusions 25. As a result, bounce-out of the memory card 100 can be prevented. Since the elastic protrusions 25 each are formed by providing two slits 24 on the top plate 20*a* in parallel and bending an intermediate part disposed between the slits 24 so as to protrude downward, it is possible to provide the connector capable of preventing bounce-out of the memory card at low costs.

(Second Embodiment)

Subsequently, a connector for memory card in accordance with a second embodiment of the present invention will be described in detail with reference to figures. Description of parts common to the parts in the above-mentioned first embodiment is omitted.

In the second embodiment, as shown in FIG. 8 to FIG. 11, plate spring-like elastic protrusions 26 are formed by cutting regions where the recessed portions 103 for locking pass while the slider 5 moves to the initial position at the front end after departing the terminals 104 of the memory card 100 from the contacts 10, on the top plate 20*a* of the cover shell 2, when the memory card 100 is taken out. A front end of the elastic protrusion 26 is connected to the top plate 20*a* to become a fixed end, and a free end protrudes downward and comes into contact with the top face of the memory card 100.

By such a configuration, similar to the above-mentioned first embodiment, during the movement of the slider 5 and the memory card 100 in the cross direction, the elastic protrusions 26 come into contact with the top face of the memory card 100 and apply the brake due to friction. Furthermore, since the elastic protrusions 26 engage in the recessed portions 103 for locking just before the slider 5 and the memory card 100 return to the initial position, it is possible to reduce a force to push out the memory card 100 rapidly and reliably by elastic force of the elastic protrusions 26. As a result, bounce-out of the memory card 100 can be prevented. Since the elastic protrusions 26 each are formed by cutting and bending downward the top plate 20*a* of the cover shell 2, it is possible to provide the connector capable of preventing bounce-out of the memory card at low costs.

This application is based on Japanese Patent Applications No. 2003-148224 and No. 2003-158359 and their contents should be incorporated into the present invention by reference of specifications and figures of the above-mentioned patent publications.

While the present invention has been fully described in the embodiments with reference to the appended figures, it will be obvious to those skilled in the art that various changes and modifications may be made. It is therefore to be understood that such changes and modifications fall within the scope of the present invention without departing from the scope of the present invention.

INDUSTRIAL APPLICABILITY

As described above, according to the connector for memory card of the present invention, since the inclined plane that becomes inclined so as to come closer to the fixed contact plate as approaching to its both sides in the directions perpendicular to the direction that the fixed contact plate is opposed to the movable spring piece and the cross direction, respectively, is formed on the contact area of the movable spring piece with the fixed contact plate, in spite of positional variation in the movable spring piece, the inclined plane of the movable spring piece comes into contact with the fixed contact plate at two points and thus contact state between the fixed contact 30*a* and the elastic contact portion 31*a* can be stabilized.

Furthermore, since the elastic protrusions are provided at the regions where the recessed portions for locking pass while the slider moves to the initial position at the front end after departing the terminals of the memory card from the contacts, when the memory card is taken out, the elastic protrusions come into contact with the top face of the memory card and apply the brake due to friction, during forward and backward movement of the slider and memory card. Still furthermore, since the elastic protrusions engage in the recessed portions for locking just before the slider and the memory card return to the initial position, it is possible to reduce a force to push out the memory card rapidly and reliably by elastic force of the elastic protrusions. As a result, bounce-out of the memory card can be prevented.

The invention claimed is:

1. A connector for a memory card comprising:

a housing having a card inserting slot on its front face;

a contact block that holds a plurality of contacts configured to contact with terminals provided on a face of the memory card and is disposed in a vicinity of a rear end in said housing so that said contacts face said card inserting slot;

a slider that configured to contact the memory card inserted into said housing and move in said housing along an inserting direction of the memory card; and a detection switch comprising:

a fixed contact plate and a movable spring piece, which are held on said contact block so as to protrude in the insertion direction of the memory card, and are configured to detect when the memory card is inserted into said card insertion slot, wherein said spring piece has a generally V-shaped channel provided on a contacting portion of said spring piece, which is configured to contact a fixed contact provided on the fixed contact plate, and wherein the V-shaped channel extends along a longitudinal length of said spring piece.

2. The connector according to claim 1, wherein said fixed contact plate, which is formed by pressing a metal plate, contacts said movable spring piece at an end face thereof, and the wherein said generally V-Shaped groove of said spring piece is formed by pressing said metal plate.

3. The connector according to claim 1, wherein said housing is formed having a generally box shape by pressing, punching and bending a metal thin plate; and said elastic protrusions are formed in a shape of a plate spring by cutting a face of said housing, wherein said elastic protrusions are configured to engage opposing recessed portions of the memory card to lock the memory card inside said housing, and wherein said elastic protrusions have a fixed end connected to the housing and a free end protruding toward the side of the memory card.

4. The connector according to claim 1 wherein said plurality of contacts, said fixed contact plate and said movable spring piece are formed by pressing a same metal plate.

5. The connector according to claim 4, wherein a thickness of a portion of said movable spring piece, excluding at least the contacting portion with said fixed contact plate and a portion held on said contact holder, is made thinner than that of a portion held on the contact holder such that the thickness prevents set caused by the memory card deforming said spring piece, when the memory card is inserted.

6. The connector according to claim 1, further comprising:

a pressing spring for pressing said slider in a direction of removing the memory card;

a push-on and push-off locking mechanism that locks movement of said slider when said slider is moved to a locking position inward of a position at which terminals of the memory card come into contact with said plurality of contacts, and releases locking of said slider when said slider is moved to a lock releasing position inward of the locking position; and elastic protrusions provided in portions of said housing, wherein said elastic protrusions are configured to engage corresponding recessed portions formed on the memory card such that when said slider moves to an initial position at a front end of said card inserting slot the memory card is locked inside said card inserting slot.

7. The connector according to claim 6, wherein said housing is formed having a generally box shape by pressing, punching and bending a thin metal plate; and said elastic protrusions are formed by forming a plurality of sets of slits on a face of said housing opposing to recessed portions, and wherein protruding center portions, of intermediate portions disposed between said plurality of sets of slits, extend toward a side of the memory card.

8. A connector for a memory card comprising:

a housing having a card-inserting slot on its front face;

a contact block that holds a plurality of contacts configured to come into contact with terminals provided on a face of the memory card, and that is disposed proxiamte a rear end in said housing such that said contacts face said card-inserting slot;

a slider configured to contact the memory card inserted into said housing and move in said housing along an inserting direction of the memory card;

a push-on and push-off lock that locks movement of said slider when said slider is moved to a locking position inward of a position at which terminals of the memory card come into contact with said plurality of contacts, and that releases locking of said slider when said slider is moved to a lock releasing position inward of the locking position;

elastic protrusions provided in portions of said housing, wherein said elastic protrusions are configured to engage corresponding recessed portions formed on the memory card such that when said slider moves to an initial position at a front end of said card insertion slot the memory card is locked inside said card-inserting slot; and a detection switch comprising a fixed contact plate and a movable spring piece, which are held on said contact block so as to protrude in the insertion direction of the memory card, and are configured to detect when the memory card is inserted into said card-inserting slot.

9. The connector according to claim 8, wherein said housing generally has a box shape; and said elastic protrusions comprise a plurality of sets of slits on a face of said housing opposing to recessed portions, and wherein protruding center portions of intermediate portions disposed between said plurality of sets of slits extend toward a side of the memory card.

10. The connector according to claim 8, wherein said housing generally has a box shape; and said elastic protrusions comprise a plate spring, wherein the elastic protrusions are configured to engage opposing recessed portions of the memory card to lock the memory card inside said housing, and wherein said elastic protrusions have a fixed end connected to the housing and a free end protruding toward the side of the memory card.

* * * * *

UNITED STATES PATENT AND TRADEMARK OFFICE

CERTIFICATE OF CORRECTION

PATENT NO. : 7,210,950 B2
APPLICATION NO. : 10/548433
DATED : May 1, 2007
INVENTOR(S) : H. Tanaka et al.

It is certified that error appears in the above-identified patent and that said Letters Patent is hereby corrected as shown below:

At column 14, line 63, before “wherein” delete “the”.
At column 16, line 5, “proximate” should be --proximate--.

Signed and Sealed this

Third Day of June, 2008

JON W. DUDAS
*Director of the United States Patent and Trademark Office*